US005305803A

United States Patent [19]

Steinberger

[11] Patent Number: 5,305,803

[45] Date of Patent: Apr. 26, 1994

[54] RETOOLABLE TROUGH-SHAPED SPREADER TABLE FOR AN AIR LOOM

[75] Inventor: Rainer Steinberger, Lindau/B., Fed. Rep. of Germany

[73] Assignee: Lindauer Dornier GmbH, Lindau, Fed. Rep. of Germany

[21] Appl. No.: 47,555

[22] Filed: Feb. 22, 1993

[30] Foreign Application Priority Data

Feb. 24, 1992 [DE] Fed. Rep. of Germany ..... 4205514

[51] Int. Cl.[5] ..... D03D 49/00

[52] U.S. Cl. ..... 139/435.1; 139/291 R

[58] Field of Search ..... 139/435.1, 291 R, 292, 139/188 R, 192

[56] References Cited

U.S. PATENT DOCUMENTS 3,885,600 5/1975 Altmann .
3,967,655 7/1976 Sejbal et al. ..... 139/291 R
4,919,171 4/1990 Dornier .
4,951,717 8/1990 Riezler ..... 139/435.1
5,070,912 12/1991 Ludwig .

FOREIGN PATENT DOCUMENTS 0292429 11/1988 European Pat. Off. .
495300 4/1930 Fed. Rep. of Germany ... 139/291 R

*Primary Examiner*—Andrew M. Falik
*Attorney, Agent, or Firm*—W. G. Fasse; W. F. Fasse

[57] ABSTRACT

A retoolable spreader table for an air loom has a trough-shaped cross-section. The spreader table has a projection pointing substantially toward the center of the weft thread insertion channel of a weaving reed. The projection forms with its upper side a support surface for the fabric. The spreader table is equipped with a first spreader element or forward spreader element positioned at the spreader table inlet and a second spreader element positioned at the outlet of the spreader table. A fabric detour element is positioned between the forward and rearward spreader elements in such a way that a slot is formed between the inlet spreader element (8) and a free end of the trough-shaped detour element (12). The fabric slot (16) has a free passage width that is variable, depending on the diameter (D) of a spreader rod (15) that is carried by the fabric (7) in a rotating manner and that is easily insertable into the space encircled by the trough table (1) and the detour element (12). This space can be opened for exchanging the rod (15) against another rod with a different rod diameter.

9 Claims, 5 Drawing Sheets

RETOOLABLE TROUGH-SHAPED SPREADER TABLE FOR AN AIR LOOM

FIELD OF THE INVENTION

The invention relates to a trough-shaped spreader table for an air loom. The table can be quickly retooled for adaptation to different types of fabrics.

BACKGROUND INFORMATION

Spreader tables are generally known, for example, from U.S. Pat. No. 4,919,171 (Dornier), issued Apr. 24, 1990, and U.S. Pat. No. 5,070,912 (Ludwig), issued Dec. 10, 1991. Such spreader tables have a projection pointing in a direction opposite to the fabric travel direction and the projection extends substantially toward the center of a weft thread insertion channel in the weaving reed. The upwardly facing side of the projection forms a support surface for the fabric. A forward spreader element is normally arranged at the inlet of the spreader table and a rearward spreader element is arranged at the outlet of the spreader table.

Depending on the type of fabric, different constructions of fabric spreaders are used on looms in order to spread each fabric individually in accordance with its particular characteristics. Quite a number of different approaches have been taken heretofore in order to assure the proper spreading of any type of fabric. However, a spreader that can be retooled for use in connection with different types of fabrics must be efficiently retoolable. Such a spreader would be especially advantageous if the retooling operations could be kept to a minimum, so as to reduce the required man hours for the retooling, yet provide a proper adaptation for the particular type of fabric to be produced.

European Patent Publication 0,292,429, (Knaus) published Nov. 23, 1988, disclosed an apparatus for spreading the fabric as it is produced in a loom in which a carrier is provided that extends in parallel to the weft thread insertion direction. The carrier supports passive spreader elements which include at least one fixed fabric support and an exchangeable detour element for the fabric. The support and the detour element extend over the entire weaving width. The exchangeable detour element cooperates with an exchangeable active spreader element for increasing the looping angle of the active spreader element, which is constructed as a spreader roller or cylinder. The spreader roller or cylinder around which the fabric loops is necessarily rotated by the motion of the fabric between the passive spreader element and the fabric support. This type of construction substantially solves the problem of adapting the spreader and support apparatus to different types of fabrics by exchanging a few elements, but there is no room for improvement.

European Patent Publication 0,412,294, (Ludwig) published Feb. 13, 1991, which corresponds to U.S. Pat. No. 5,070,912, discloses an air loom with a spreader table that encircles like a trough a spreader member which is effective along the fabric margin. The spreader table also has a projection that extends toward the center of the weft thread insertion channel in the weaving reed in the area of the forward fabric detour. The upwardly facing side of the projection forms an extension of the support surface of the spreader table. Two spreader elements are integrated into the construction. One spreader element is arranged in the transition area between the projection and the trough of the spreader table that is in the inlet portion of the spreader table. The other spreader element is arranged at the fabric exit or outlet of the spreader table. Preferably, the spreader elements extend along the entire weaving width. The spreader table according to European Patent Publication 0,412,294 combines a plurality of features that assure certain advantages, such as an excellent centering of the beat-up point or line and a fabric spreading that functions in a plurality of ways. Nevertheless, the spreader table of European Patent Publication 0,412,294 is not universally usable for any desired type of fabrics to be produced on air nozzle looms. The types of fabrics in which it is advantageous to employ a so-called rod spreader require a retooling of the loom. Such rod spreaders assure a substantially more advantageous fabric looming angle around the spreader rod.

OBJECTS OF THE INVENTION

In view of the above it is the aim of the invention to achieve the following objects singly or in combination:

to improve a spreader table of the type just described in such a way that it can be retooled in an optimally short time duration to form a rod spreader for improving the looping angle of the fabric around the rod and without retooling the loom;

to provide a spreader table construction that is adaptable without an expensive and time consuming retooling of the loom, to different types of fabrics, while simultaneously assuring that the functions of fabric spreading and fabric clamping are properly performed simultaneously to prevent a pullback of the fabric being produced; and to construct the spreader table in such a way that the looping angle and/or fabric gap width can be varied.

SUMMARY OF THE INVENTION

According to the invention the above objects have been achieved by the arrangement of a fabric detour element constructed as a half shell, between the rear or exit spreader element and the inlet or forward spreader element that is integrated into the spreader table in the area of the forward fabric detouring. The half shell fabric detouring element is connectable to the spreader table trough in a form-locking or force-locking manner by respective form-locking cooperating components or force locking connector elements. Further, a fabric gap, is formed between the forward spreader element and the free end, or rather free edge of the half shell. The fabric gap has a clear passage width that is variable as a function of the diameter of a spreader rod carried by the fabric. Such a structure can be adapted to different types of fabric with a minimum of retooling efforts.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
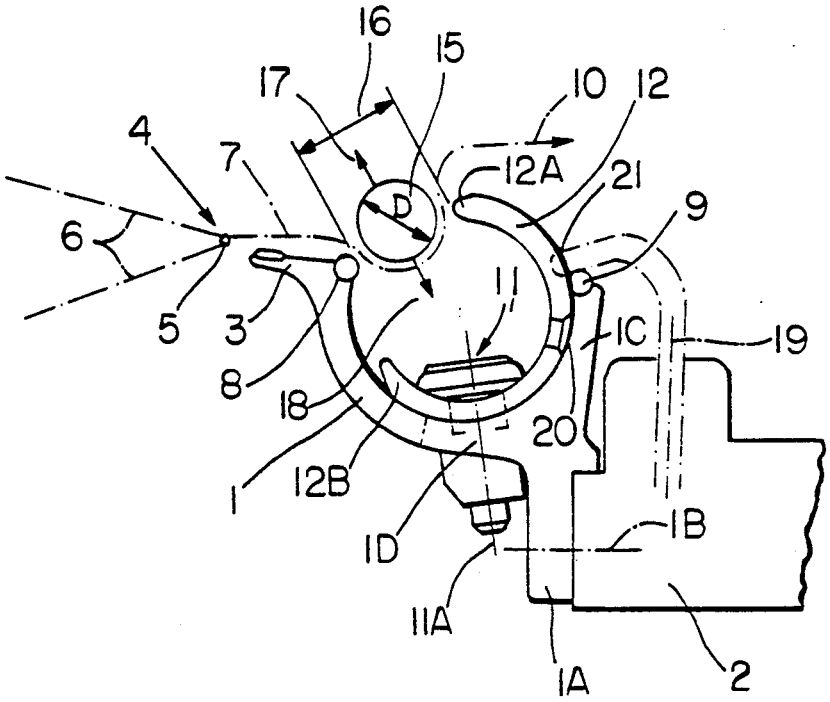
FIG. 1 shows an end view illustrating the fabric detouring half shell in a position within a trough of the spreader table in which the fabric spreader rod can either be inserted or withdrawn from the space encircled at least partly by the half shell.

Referring to FIG. 1, the spreader table 1 has a trough configuration as viewed in the axial direction. The trough-shaped spreader table 1 is mounted to the loom frame 2 by a bracket 1A. The loom itself is not shown. Screws symbolically shown at 1B permit the removal of the spreader table 1 and its bracket 1A as a unit. The trough-shaped spreader table 1 extends over the entire weaving width of the loom.

A projection 3 points in the direction opposite of the fabric travel indicated by the arrow 10. The projection 3 points substantially toward the beat-up point or line 4 where the weft thread 5 is bound by the warp threads 6 to form the fabric. The finished fabric 7 travels through the spreader table as will be described in more detail below. The projection 3 or rather its upwardly facing side forms a fabric support that leads toward a spreader element 8 integrated into the front end portion of the spreader table 1. The front end faces opposite to the travel direction 10.

A further spreader element 9 is integrated into the rear portion 1C of the table 1. A needle roller not shown here, however, known from European Patent Publication 0,412,294, or from U.S. Pat. No. 3,885,600 is conventionally mounted for rotation in the trough-shaped portion of the table 1. The fabric 7 travelling from the front or inlet portion of the table to the exit or rear portion thereof partially loops around such a needle roller or cylinder. The needle roller makes sure, depending on its surface structure that may differ along its length, that the fabric web is properly spread primarily in its fabric margin zones. The features so far described and as far as they relate to the spreader table itself, are described in more detail in the above mentioned European Patent Publication 0,142,294.

For certain types of fabrics to be produced on air nozzle looms, it is, however, necessary to assure that the function of fabric spreading and the function of fabric clamping are properly performed simultaneously. Such simultaneous performance of the two functions is necessary, because without these functions it is possible that other loom components not shown would tend to pull back the finished fabric 7 in a direction opposite to its fabric withdrawal direction indicated by the arrow 10. Such pull back, if not properly countered or compensated, leads to a quality reduction of the fabric which must be avoided.

Referring further to FIG. 1, the spreader table 1 according to the invention comprises a half shell shaped detour element 12 that is so constructed that it can be mounted in different positions within the trough formed by the table 1. For this purpose, mounting elements 11 are either permanently or removably secured to a bottom portion 1D of the table 1. The central axis 11A of the mounting elements 11 may extend centrally and vertically, or it may be slightly slanted relative to the vertical as shown in FIG. 1. The cooperation of the mounting elements 11 with the half shell detour element 12 will be described in more detail below with reference to FIG. 4.

Figure 4:
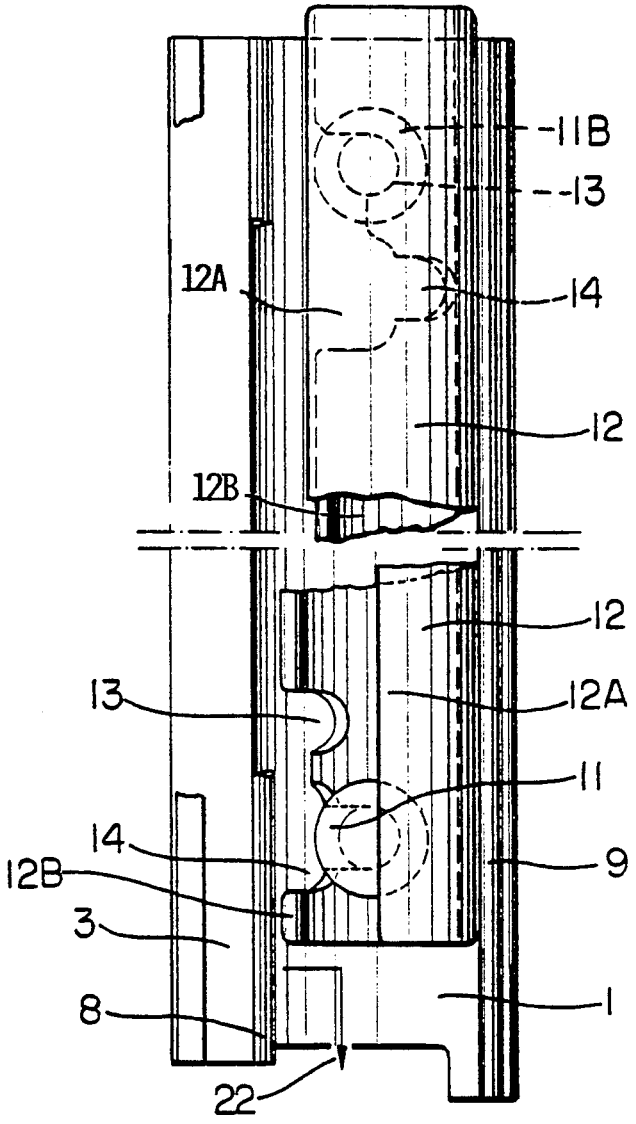
FIG. 4 shows a plan view of the half shell in its positions corresponding to FIGS. 1 and 3.

Referring to FIG. 4, the half shell detour element 12 is provided in its downwardly facing portion with shallower recesses 13 and with deeper recesses 14. These recesses 13, 14 extend circumferentially away from the lower edge 12B of the approximately half shell shaped detour element 12. The lower portion of FIG. 4 shows the detour element 12 in the same position as in FIG. 1, whereby the upper detour edge 12A of the element 12 is circumferentially displaced in the clockwise direction relative to the lower edge 12B of the element 12, and whereby the mounting element 11 engages a deeper recess in the element 12 for holding the element 12 securely inside the trough of the table 1.

Figure 3:
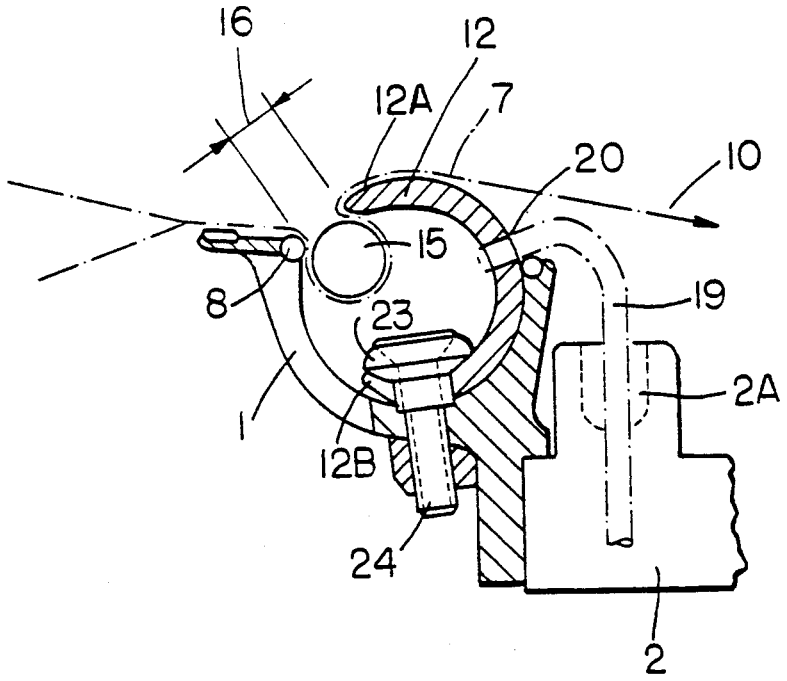
FIG. 3 is a sectional view illustrating the half shell in an operating position, wherein the spreader rod is located next to the fabric gap.

The upper portion of FIG. 4 shows the element 12 in the position of FIG. 3, wherein the mounting element 11B engages a shallower recess 13. For this engagement, it is necessary to first release the engagement shown in the lower portion of FIG. 4 by rotating the element 12 counterclockwise, and then displacing it axially until the mounting element aligns with the shallower recess 13, whereupon the element 12 is rotated clockwise and the mounting elements are again engaged, but now with the shallower recesses 13. In the upper portion of FIG. 4, the upper edge 12A and the lower edge 12B of the element 12 are approximately in vertical alignment with each other.

Figure 2:
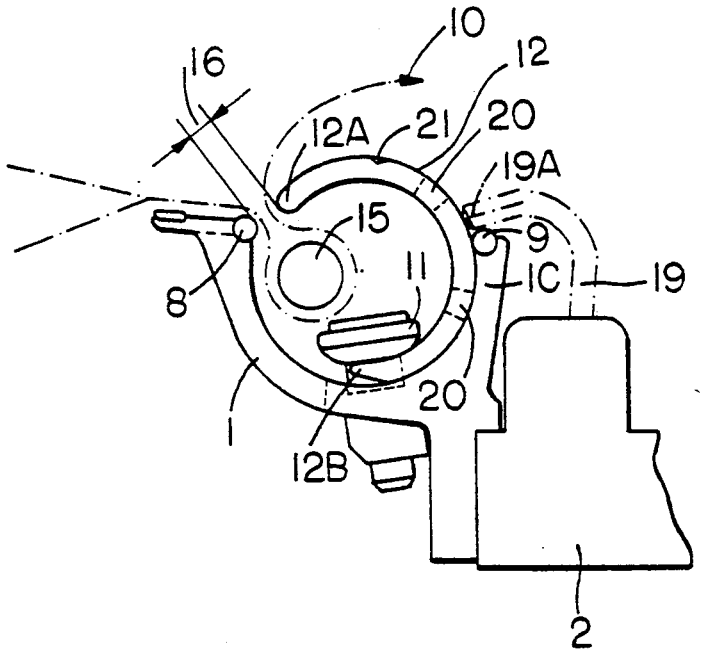
FIG. 2 shows a view similar to that of FIG. 1, however illustrating the half shell in a position defining an optimal fabric gap with the spreader rod substantially encircled by the half shell, whereby half shell holding elements now engage different recesses in the half shell as compared to the position of the half shell in FIG. 1.

When the detour element 12 is in the position shown in FIG. 1, and in the lower portion of FIG. 4, a spreader rod 15 having a diameter D can be either inserted into the trough as indicated by the arrow 18, or it can be removed from the trough as indicated by the arrow 17. For this purpose, the fabric gap 16 has its largest free passage width as indicated by the respective double arrow. The fabric 7 forms a loop around the rod 15 as seen in FIGS. 1, 2, and 3. However, the size of the looping angle around the rod 15 depends according to the invention, on the relative position of the forward or upper edge 12A of the detour element 12 relative to the spreader element 8 which forms the fabric gap 16 together with the edge 12A.

FIGS. 1, 2, and 3 show torque stop members 19 in the form of spring elastic pins or fingers, one end of which is rigidly mounted in the loom frame 2 and the other end of which engages a notch or kerf 21 in the outer surface of the detour element 12. Instead of a kerf or notch 21, a bore 20 may be used for engaging the free end of a torque stop pin 19, whereby rotation of the element 12 is possible only after the spring force of the pin 19 has been overcome. The kerfs 21 or bores 20 are circumferentially spaced from each other. A plurality of such torque stop pins 19 may be distributed along the length of the element 12. The engagement between the pins 19 and the bores 20 or kerf 21 secures the element 12 against rotation and against axial displacement until the spring force is overcome or disengaged.

FIG. 2 shows the element 12 in an intermediate position in which the free end 19A of the torque stop pin 19 is not engaged with any of the bores 20. The element 12 has been rotated counterclockwise so that the gap between its upper edge 12A and the spreader element 8 is at its minimum as shown at 16 in FIG. 2. In this position the mounting elements 11 are not anymore engaged with the deeper recesses 14. The element 12 can now be axially shifted within the trough of the table 1 in the direction of the arrow 22 shown in FIG. 4, until the mounting elements 11 come into alignment with the shallower recesses 13, whereupon a clockwise rotation engages the recesses 13 with the mounting elements 11 to lock element 12.

FIG. 3 shows the position of the detour element 12 in the trough-shaped table 1, wherein the fabric is properly spread and simultaneously clamped between the spreader element 8 and the rod 15 on the one hand and the rod 15 and the edge 12A of the element 12 on the other hand. In this position the mounting elements 11 engage the shallow recess 13. However, in FIG. 3 the mounting elements 11 have been replaced, for example, by a centering piece 23 that is engaged with a set screw 24 in a form-locking manner, thereby firmly holding the element 12 in place inside the trough of the table 1. It is to be noted, that the edges of the recesses 13, 14 are so dimensioned that the cylindrical neck of the centering piece 23 can be received with the sufficient play. As shown in FIG. 3, the spring elastic torque lock pin 19 engages the bore 20, thereby keeping the element 12 against rotation and against axial displacement. As shown at 2A the pins 19 are so mounted in the frame 2 that they can be elastically pulled out of the bore 20 to release the element 12 for circumferential and axial displacement.

Incidentally, where a force-locking engagement between the mounting elements 11 and the recesses 13, 14 in the element 12 keeps the latter in place, the edges of the recesses 13 and 14 will be correspondingly dimensioned relative to the dimensions of the mounting elements 11 to provide for the proper force-locking between the element 12 and the mounting elements 11 to hold the element 12 in the trough of the table 1.

In FIG. 3 the gap 16 has assumed its operational width, whereby the looping angle of the fabric 7 around the rod 15 holds the latter inside the space encircled by the table 1 and the element 12, because the gap width of the gap 16 is smaller than the diameter D of the spreader rod 15.

Figure 5:
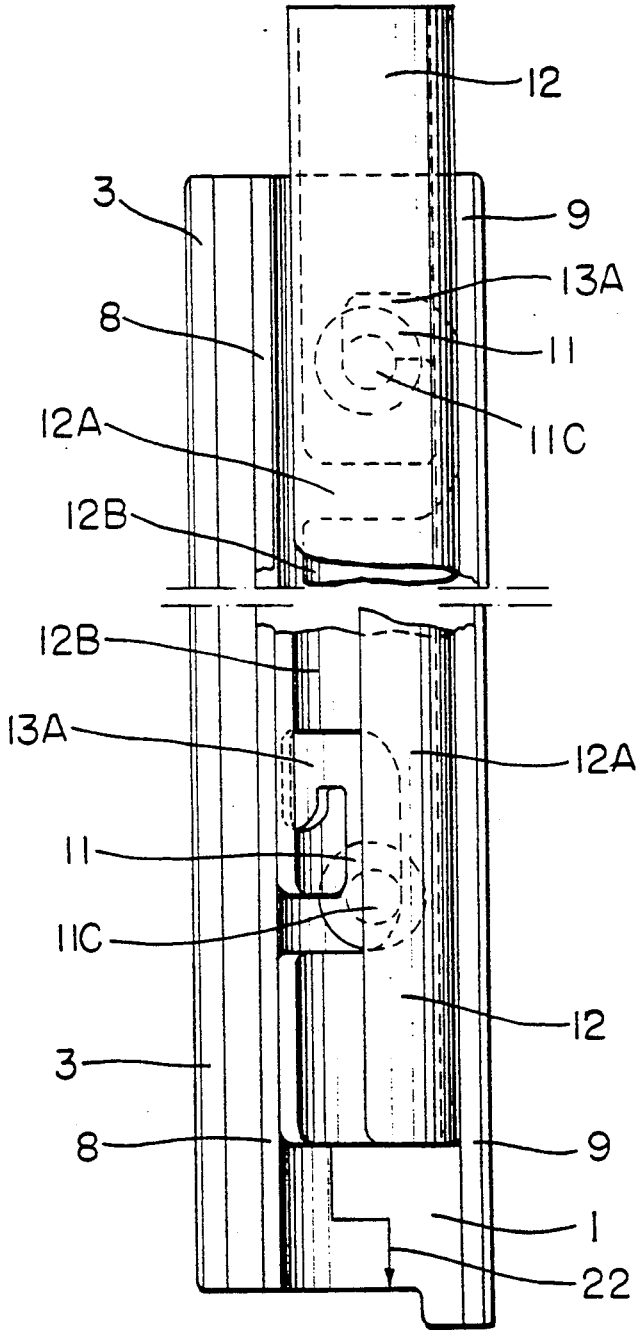
FIG. 5 shows a bayonet slide lock for holding the half shell in the trough of the spreader table.

FIG. 5 shows the mounting of the half shell spreader element 12 in the trough of the spreader table 1 by a bayonet slide lock. The elements that are designated in FIG. 5 by the same reference numbers as in FIG. 4 are not described again. The half shell spreader element 12 is provided with a bayonet recess 12A. The spreader table 1 is provided with a bayonet arresting pin 11C. In the upper portion of FIG. 5, the pin 11C fully engages the recess 12A to lock the element 12 to the spreader table 1. In the lower portion of FIG. 5 the pin 11 is in an unlocking position, whereby rotation of the element 12 will disengage the pin 11C from the element 12.

Although the invention has been described with reference to specific example embodiments, it will be appreciated that it is intended to cover all modifications and equivalents within the scope of the appended claims.

What I claim is:

1. A retoolable trough-shaped fabric spreader table for an air loom, comprising a table projection pointing substantially toward the center of a weft thread insertion channel, said table projection having an upper surface forming an extension of a fabric support of said spreader table, said spreader table further comprising a first spreader element (8) arranged at an inlet of said spreader table and a second spreader element (9) at an outlet of said spreader table, wherein said fabric spreader table forms a trough between said spreader elements (8, 9), a half shell shaped fabric detour element (12) insertable into said trough of said spreader table (1), means (11, 23, 24) for mounting said fabric detour element (12) inside said spreader table (1) in a form-locking and force-locking manner for a circumferential and axial displacement of said fabric detour element (12) relative to said spreader table (1), and wherein a fabric slot (16) is formed between said first spreader element (8) and a free edge (12A) of said fabric detour element (12), said slot having a clear passage width that is variable by said circumferential displacement of said fabric detour element (12) in accordance with a diameter (D) of a spreader rod (15) insertable into said trough, said spreader rod (15) being supported by a fabric (7) for simultaneously spreading and clamping said fabric.

2. The spreader table of claim 1, wherein said fabric detour element (12) is arranged as a single piece member extending over the entire length of said trough-shaped spreader table (1).

3. The spreader table of claim 2, wherein said first spreader element (8) and said free edge (12A) of said half shell shaped detour element (12) extend in parallel to each other, and wherein said first spreader element (8) and said free edge (12A) together guide the spreader rod (15) against the pull exerted by said fabric (7).

4. The spreader table of claim 1, wherein said detour element (12) comprises in its area connected to said spreader table (1) at least forward and rearward recesses or cut-outs (13, 14).

5. The spreader table of claim 4, wherein said recesses or cut-outs (13, 14) are spaced from each other along the length of said detour element (12).

6. The spreader table of claim 4, further comprising mounting means (11) in said spreader table trough, said recesses (13, 14) being releasably engaged by said mounting means (11) which are rigidly secured in said trough of said spreader table (1).

7. The spreader table of claim 4, further comprising mounting means in said spreader table trough, and wherein said recesses are connected to said mounting means (11) which are adjustably arranged in said spreader table trough.

8. The spreader table of claim 7, wherein said mounting means are constructed as a bayonet slide lock.

9. The spreader table of claim 4, further comprising mounting means (24) releasably held in said spreader table trough, said recesses being releasably engaged by said mounting means (24).

* * * * *

UNITED STATES PATENT AND TRADEMARK OFFICE

CERTIFICATE OF CORRECTION

PATENT NO. : 5,305,803

DATED : April 26, 1994

INVENTOR(S) : Rainer Steinberger

It is certified that error appears in the above-identified patent and that said Letters Patent is hereby corrected as shown below:

Col. 1, line 55, delete "no".

Col. 3, line 47, replace "0,142,294" by --0,412,294--.

Col. 4, line 16, after "recess" insert --14--.

Col. 5, line 47, replace "12A" by --13A--;

line 50, replace "12A" by --13A--.

Signed and Sealed this

Second Day of August, 1994

*Attest:*

Bruce Lehman

BRUCE LEHMAN

*Attesting Officer*

*Commissioner of Patents and Trademarks*